US008225439B2

(12) United States Patent
Cabrera et al.

(10) Patent No.: US 8,225,439 B2
(45) **Date of Patent: *Jul. 24, 2012**

(54) SLEEPER SOFA

(76) Inventors: Joseph Cabrera, San Diego, CA (US); Louis Rodriguez, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/085,403

(22) Filed: Apr. 12, 2011

(65) Prior Publication Data

US 2011/0214231 A1 Sep. 8, 2011

Related U.S. Application Data

(63) Continuation of application No. 12/001,810, filed on Dec. 13, 2007, now Pat. No. 7,945,974.

(60) Provisional application No. 60/975,759, filed on Sep. 27, 2007, provisional application No. 61/005,311, filed on Dec. 4, 2007.

(51) Int. Cl.
*A47C 17/13* (2006.01)

(52) U.S. Cl. ..... 5/47; 5/37.1; 5/42

(58) Field of Classification Search ..... 5/13, 37.1, 5/38, 41, 42.1, 47, 48, 53.1, 56, 59.1
See application file for complete search history.

(56) References Cited

U.S. PATENT DOCUMENTS

| | | | | |
|---|---|---|---|---|
| 1,295,935 | A | 3/1919 | Sowle | |
| 1,903,918 | A * | 4/1933 | Fraser et al. | 5/42.1 |
| 2,730,727 | A * | 1/1956 | Schneller | 5/38 |
| 3,002,198 | A * | 10/1961 | Kaiser, Jr. | 5/41 |
| 3,015,112 | A | 1/1962 | Wachsman | |
| 4,538,308 | A * | 9/1985 | Grigoriev | 5/42.1 |
| 4,737,996 | A | 4/1988 | Tiffany | |
| 4,803,742 | A * | 2/1989 | Rasnick et al. | 5/18.1 |
| 4,939,802 | A * | 7/1990 | Lafer | 5/42.1 |
| 5,913,770 | A * | 6/1999 | Tseng | 5/37.1 |
| 6,668,395 | B1 | 12/2003 | Chen | |
| 6,904,628 | B2 | 6/2005 | Murphy et al. | |
| 7,040,700 | B2 | 5/2006 | Duncan et al. | |
| 7,383,596 | B2 * | 6/2008 | James et al. | 5/37.1 |
| 7,945,974 | B2 * | 5/2011 | Cabrera et al. | 5/47 |

OTHER PUBLICATIONS

Web page for "E-Z Sleeper JH-613-27", Durfold Corporation, 102 Upton Drive Jackson, MI 39209, http://www.durfold.com/index.htm, Registrant Durfold, Inc., 1 page, Copyright 2006.

(Continued)

*Primary Examiner* — Michael Trettel
(74) *Attorney, Agent, or Firm* — Stetina Brunda; Garred & Brucker

(57) ABSTRACT

A convertible sofa-bed which is easy to convert between a sofa configuration and a bed configuration is provided. From a sofa configuration, a buttock-foot member may be pulled outward. Simultaneously, a head rest member and back rest member which are initially at a generally vertical position are traversed to a generally horizontal position. When the buttock-foot member is fully traversed outward (i.e., extended position), the head rest member, back rest member and the buttock-foot member are generally substantially co-planar and generally horizontal. This provides a firm bed surface upon which a person may comfortably sleep. From the bed configuration, head rest member and the back rest member may be buckled to allow the buttock-foot member to be pushed inward. The buttock-foot member is then pushed fully inward (i.e., retracted position) until the head rest member and the back rest member are in the generally vertical position. The person may sit on the buttock-foot member and lean backwards onto the back rest member.

15 Claims, 7 Drawing Sheets

OTHER PUBLICATIONS

Web page for "Loveseat JH-613-48", Durfold Corporation, 102 Upton Drive Jackson, MI 39209, http://www.durfold.com/index.htm, Registrant Durfold, Inc., 1 page, Copyright 2006.

Web pages for "Sleepchair RP-1194", Durfold Corporation, 102 Upton Drive Jackson, MI 39209, http://www.durfold.com/index.htm, Registrant Durfold, Inc., 1 page, Copyright 2006.

"International Search Report," International Application No. PCT/US08/76892, (1 page), Date of mailing Dec. 1, 2008.

"PCT Written Opinion of the International Searching Authority," International Application No. PCT/US08/76892, (5 pages), Date of mailing Dec. 1, 2008.

Web pages for Converting Sofa-Bed ["How it Works": Sofa Position, TV Position and Bed Position ], Bonsua Fine Sofa Beds and Sectionals, http://www.bonsua.com/, Registrant Muebles Bonsua, 5 pages, Copyright Unknown.

Web pages for Converting Sofa-Bed [Catalogue: "Devito": Sofa Position, TV Position and Bed Position ], Dileto the Perfect Sofa Bed, http://www.dileto.com/vito1.html, http://www.dileto.com/vito2.html and http://www.dileto.com/vito3.html. Registrant Carlos Sanchez, 5 pages, Copyright Unknown.

* cited by examiner

SLEEPER SOFA

CROSS-REFERENCE TO RELATED APPLICATIONS

The present application is a continuation of U.S. patent application Ser. No. 12/001,810 entitled SLEEPER SOFA filed on Dec. 13, 2007 now issued as U.S. Pat. No. 7,945,974 on May 24, 2011, which claims the benefit of provisional patent application Ser. Nos. 60/975,759, filed on Sep. 27, 2007 and 61/005,311, filed on Dec. 4, 2007, the entire contents of such provisional applications are incorporated herein by reference.

STATEMENT RE: FEDERALLY SPONSORED RESEARCH/DEVELOPMENT

Not Applicable

BACKGROUND

The present invention relates to a sofa-bed.

Sofa-beds have been in existence in the United States for many decades. One deficiency in prior art sofa-beds is that they are uncomfortable to sleep in. In particular, the bed frame of the sofa-bed may support a bed cushion via a system of springs. Unfortunately, the springs may not be sufficiently rigid to support a person laying down on the bed. Accordingly, the sleeper may complain of backache or an unpleasant sleep experience.

Another deficiency in prior art sofa-beds is that the bed frame is complex and unstable. In particular, the bed frame is folded into the sofa, and more particularly, into the base portion of the sofa where the person may sit. To fold the entire bed under the base portion of the sofa, the bed frame may have numerous rotating parts to provide a pedestal to support the bed frame above the ground. Moreover, the bed frame may consist of three separate support portions. These support portions and pedestals are folded upon each other in an accordion fashion and tucked into the base portion of the sofa which add to the instability and complexity of prior art sofa-beds. Such prior art devices may be complex to manufacture, heavy and not user friendly. Accordingly there is a need in the art for an improved sofa-bed.

Exampled of prior art sofa-beds are illustrated and described in U.S. Pat. No. 6,904,628 and U.S. Pat. No. 4,737,996.

BRIEF SUMMARY

The sofa-bed discussed herein addresses the deficiencies identified above, identified below and those that are known in the art.

In an aspect of the sofa-bed of the present invention, the same may be easily converted between a sofa and a bed. In particular, a buttock-foot member is slid from a retracted position to an extended position. As the buttock-foot member is traversed to the extended position, a foldable section which is initially at a generally vertical position is then traversed to a generally horizontal position. The foldable section which may comprise a head rest member and a back rest member along with the buttock-foot member forms the bed. To provide a more comfortable sleeping experience, a bed cushion may be disposed upon the head rest member, back rest member and the buttock-foot member.

Conversely, the sofa-bed may be easily converted from the bed configuration to the sofa configuration. In particular, the user may lift a junction between the head rest member and the back rest member upward to traverse the foldable section to the generally vertical position. Simultaneously, the buttock-foot member is traversed toward the retracted position. The user then fully traverses the buttock-foot member to the retracted position.

In an aspect of the sofa-bed, the same may provide a firm back suppport upon which a guest or user may sleep upon. In particular, the head rest member, the back rest member and the buttock-foot member may have a hard flat member or a plurality of wood slats attached to upper sides thereof. When the foldable section is traversed to the generally horizontal position and the buttock-foot member is traversed to the extended position, the upper sides thereof are substantially coplanar. A bed cushion may be disposed on the hard flat member or wood slats.

To lock the sofa-bed in the sofa configuration, the buttock-foot member may have a locking member attached thereto. The locking member may be disposed behind a transverse bar to prevent forward traversal of the buttock-foot member. Also, a stop member may be disposed behind the buttock-foot member to prevent rearward traversal of the buttock-foot member.

In an aspect of the sofa-bed, the foldable section may be biased toward the generally vertical position when the foldable section is in the generally horizontal position. This aides the user in traversing the sofa-bed from the bed configuration to the sofa configuration.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 3A:
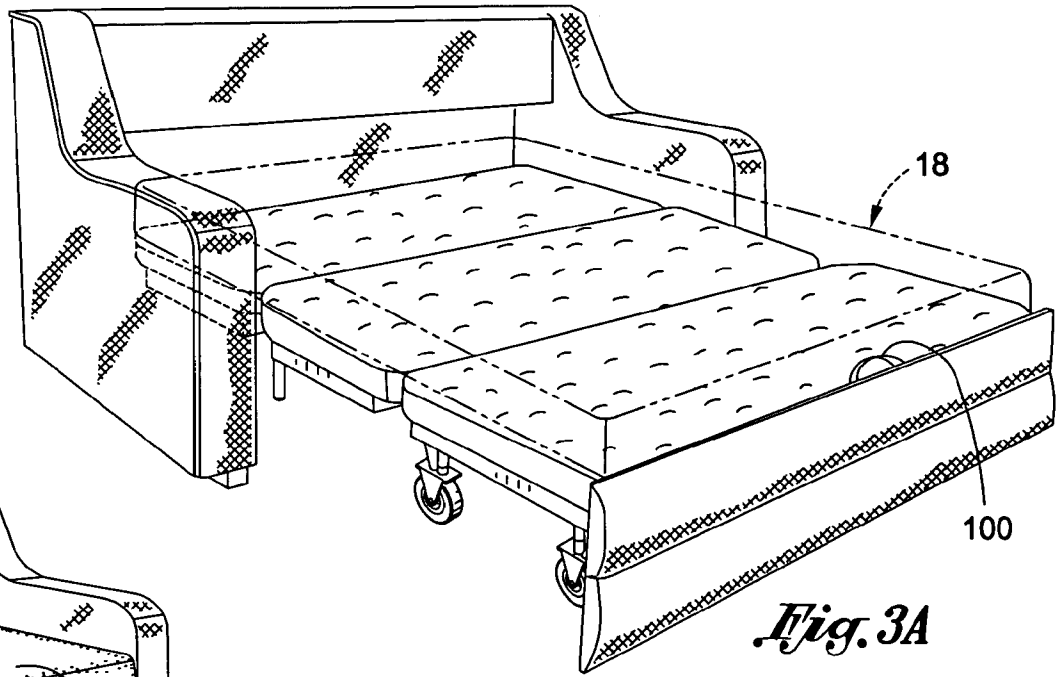
FIG. 3A is perspective view of the convertible sofa-bed shown in FIG. 1 in the bed configuration.
Figure 1:
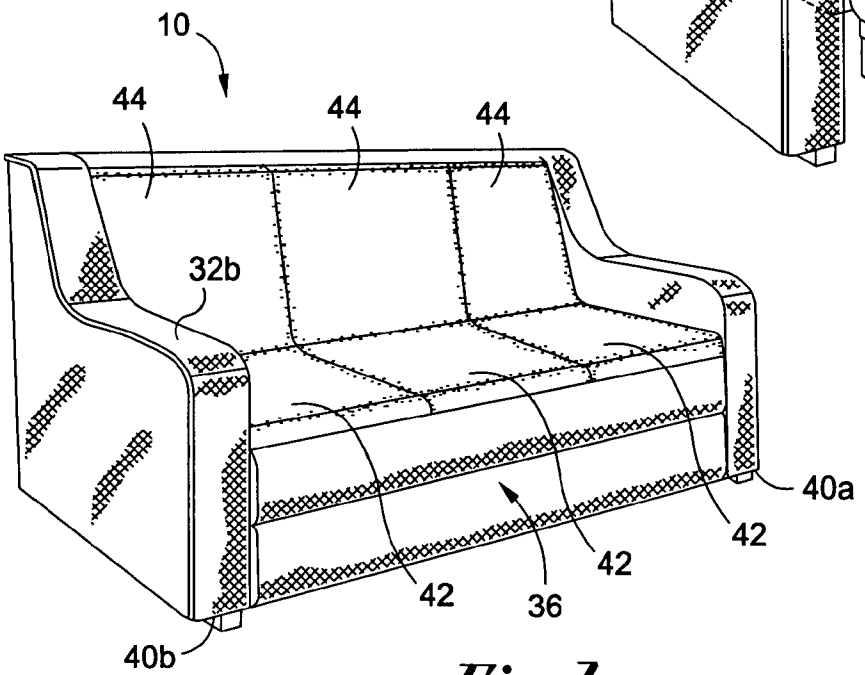
FIG. 1 is a perspective view of a convertible sofa-bed in a sofa configuration.

The present invention relates to a convertible sofa-bed 10 (see FIGS. 1 and 3A). In a folded position (see FIG. 1), a person may sit on the sofa-bed. In an unfolded position (see FIG. 3A), the person may lay flat on the sofa-bed 10. One benefit of the convertible sofa-bed 10 is that it provides efficient floor use of a person's home or hotel space. When an extra bed is required such as when a guest stays overnight at the person's home, the sofa-bed may be easily unfolded so that the guest may sleep on the sofa-bed in a comfortable manner. During the day, the sofa-bed may be easily folded such that the guest and members of the person's household may use the sofa-bed as a sofa.

Figure 2:
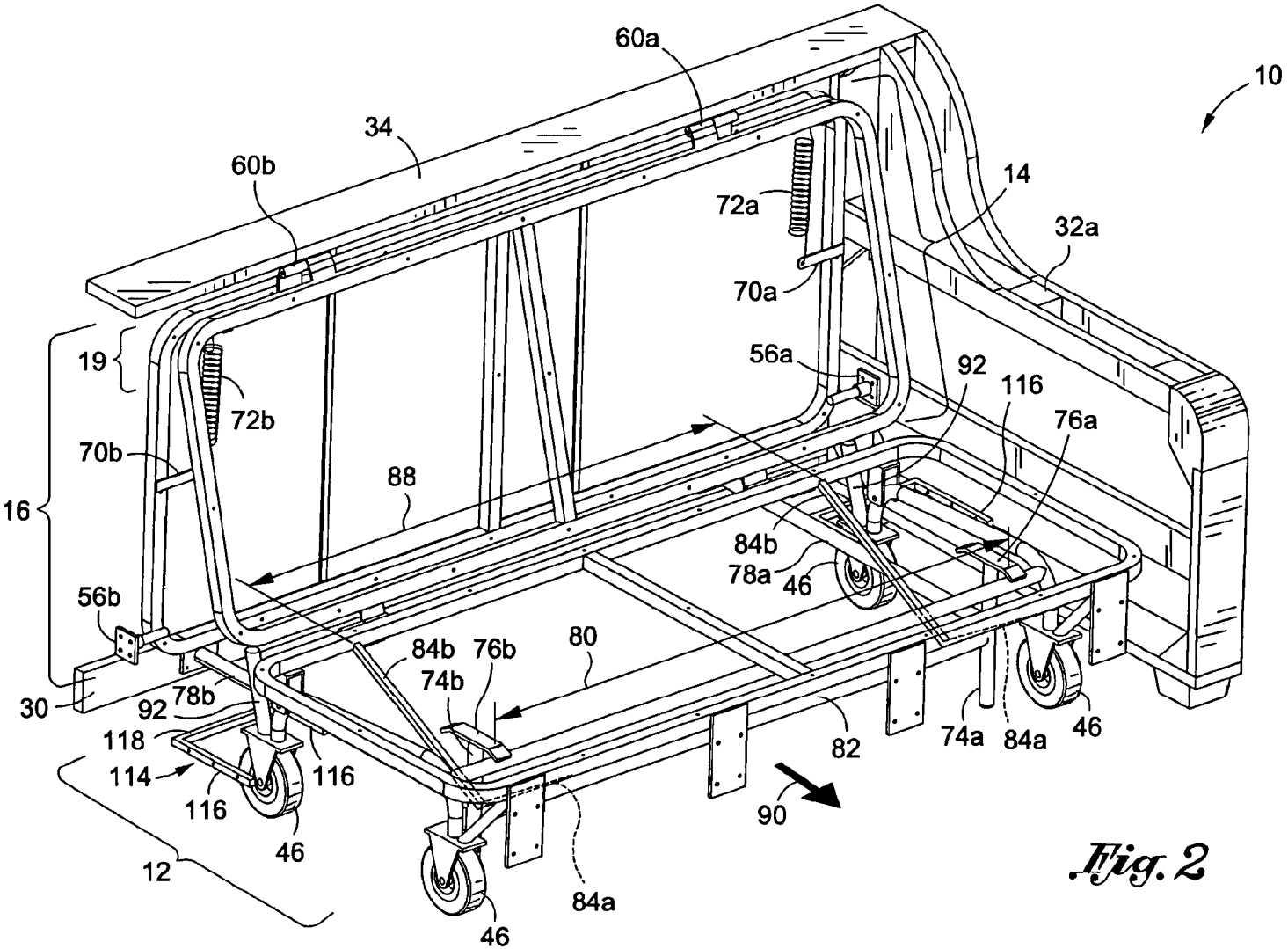
FIG. 2 is a perspective view of a frame of the convertible sofa-bed shown in FIG. 1.
Figure 3:
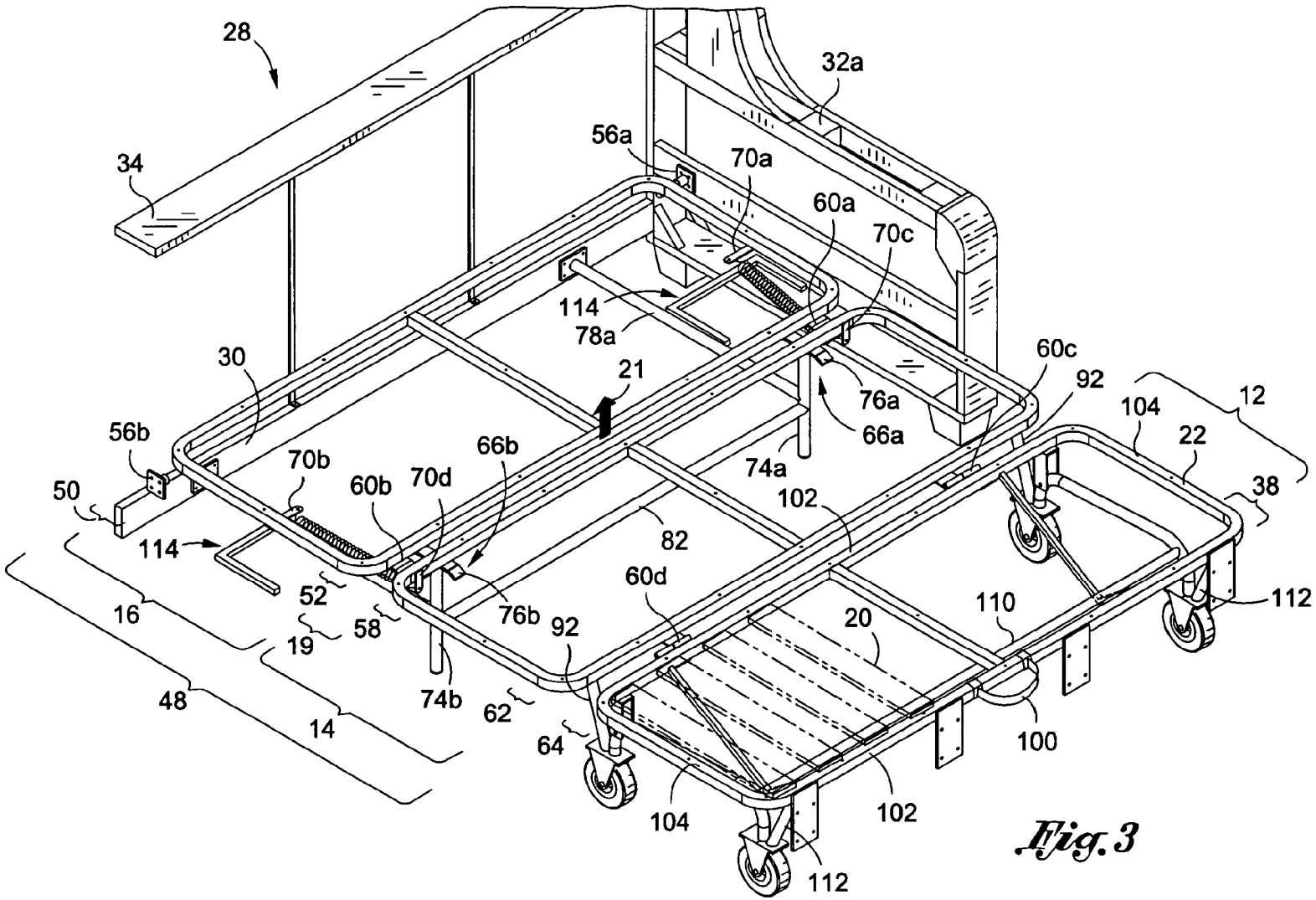
FIG. 3 is a perspective view of the frame of the convertible sofa-bed shown in FIG. 2 wherein the sofa-bed is in the bed configuration.

The sofa-bed 10 discussed herein provides an easy manner in which the sofa-bed may be converted between the sofa configuration (i.e., folded position) and the bed configuration (i.e., unfolded position). In particular, when the sofa-bed 10 is in the sofa configuration, a buttock-foot member 12 (see FIG. 2) may be pulled out (see FIG. 3) to traverse a back rest member 14 and a head rest member 16 which are initially at a generally vertical position (see FIG. 2) to a generally horizontal position (see FIG. 3). As shown in FIGS. 3 and 3A, when the buttock-foot member 12 is pulled out, the head rest member 16, back rest member 14 and the buttock-foot member 12 may collectively provide a flat support area upon which the user may lay down to sleep. An optional bed cushion 18 (e.g., foam, mattress, air mattress, etc.; see FIG. 3A) may be disposed on top of the buttock-foot member 12, back rest member 14 and the head rest member 16 to provide more comfort. The softness or hardness of the bed may be adjusted by providing a soft or a hard bed cushion 18.

The sofa-bed 10 may be converted back to the sofa configuration by traversing the back rest member 14 and the head rest member 16 to the generally vertical position. To this end, the junction 19 (see FIG. 3) between the head rest member 16 and the back rest member 14 may be pulled upward (see arrow 21 in FIG. 3) to fold these two sections 14, 16 together. The buttock-foot member 12 may be pushed back into a retracted position (see FIG. 2). Accordingly, the sofa-bed 10 provides an easy method of converting the sofa-bed 10 between a sofa configuration and a bed configuration.

In another aspect of the sofa-bed 10, a hard flat member (e.g., plywood or particle board) may be attached to each of the upper sides 22, 24, 26 (see FIG. 4) of the buttock-foot member 12, back rest member 14 and the head rest member 16. The hard flat member provides a surface upon which the bed cushion 18 may rest upon. Alternatively, a plurality of rigid boards, specifically, wood slats 20 (see FIG. 3 shown in phantom) may be attached to the upper sides 22, 24, 26 (see FIG. 4) of the buttock-foot member 12, back rest member 14 and the head rest member 16, as shown in FIG. 3. The hard flat member and/or wood slats 20 may provide firm support to the person while the person is sleeping and while the person is sitting on the buttock-foot member 12.

As described below, in another aspect of the sofa-bed 10, the same 10 may be locked into the sofa configuration such that the buttock-foot member 12 does not slide out inadvertently and traverse the sofa-bed 10 to the bed configuration. Conversely, the same may be locked into the bed configuration such that the sofa bed 10 is not inadvertently converted to the sofa configuration from the bed configuration.

The sofa-bed 10 may comprise a frame 28 (see FIG. 3). The frame 28 may comprise a rear base board 30 (see FIG. 3), left and right arm rests 32*a, b* (see FIGS. 1 and 3) and a hood member 34 (see FIG. 3). The rear base board 30 may generally define the rear of the sofa-bed 10. The left and right arm rests 32*a, b* may be attached to opposed lateral ends of the rear base board 30 and the hood member 34 and extend forwardly therefrom. As shown in FIG. 2, the rear base board 30 and the hood member 34 and the left and right arm rests 32*a, b* may circumscribe the buttock-foot member 12, back rest member 14 and the head rest member 16 when they 12, 14, 16 are in the folded position. The rear base board 30 and the left and right arm rests 32*a, b* may hide the various mechanisms which are unaesthetically pleasing. The hood member 34 may extend over the junction 19 (see FIG. 2) between the head rest member 16 and the back rest member 14 when the sofa-bed 10 is in the folded position to cover the junction 19.

The front of the sofa-bed may have a foot board 36 (see FIG. 1) attached to a proximal end portion 38 (see FIG. 3) of the buttock-foot member 12. The foot board 36 may be generally vertically oriented and may extend adjacent the upper side 22 (see FIGS. 3 and 4) of the buttock-foot member 12 to lower edges 40*a, b* (see FIG. 1) of the left and right arm rests 32*a, b*. As shown in FIG. 1, when the sofa-bed 10 is in the folded position, the foot board 36 may be aligned to the left and right arm rests 32*a, b* to hide the various mechanisms of the sofa-bed 10.

The frame 28, or more particularly, the rear base board 30, left and right arms rests 32*a, b*, hood member 34 and the foot board 36 may be covered with a cloth, as shown in FIG. 1. The cloth may have a aesthetically pleasing color and/or pattern. A soft plush cushioning material may be disposed between the cloth exterior and the frame 28. The cushioning material may provide a soft plush feel to the sofa-bed 10.

Figure 4A:
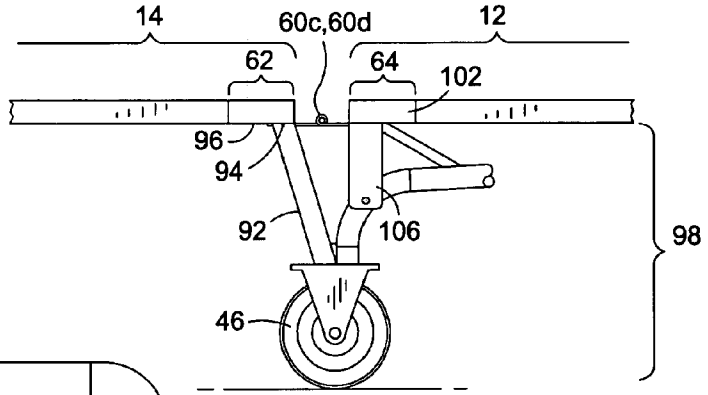
FIG. 4A is an enlarged view of the frame of the convertible sofa-bed shown in FIG. 4.
Figure 4:
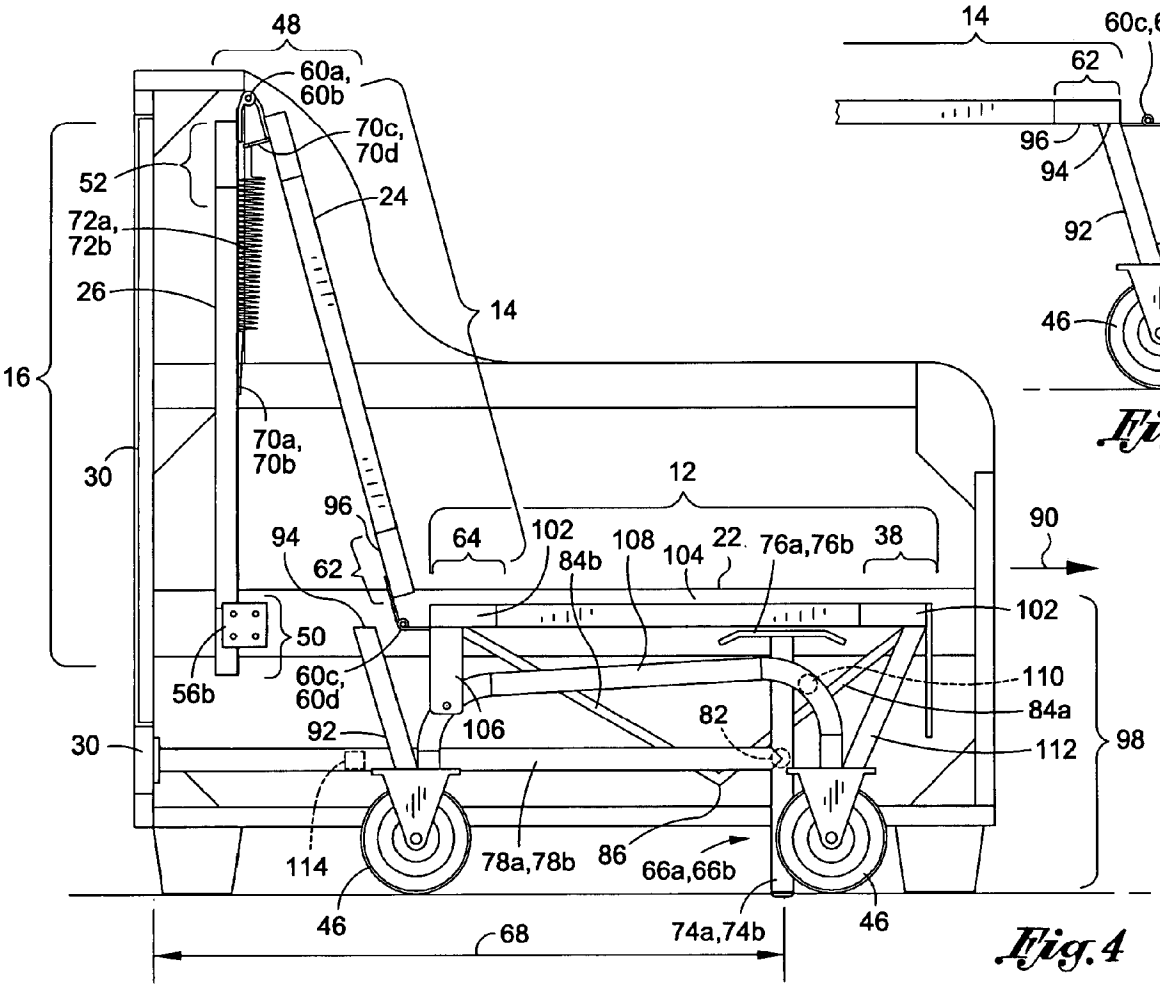
FIG. 4 is a side view of the frame of the convertible sofa-bed shown in FIG. 2.

In the folded position, as shown in FIG. 4, the back rest member 14 may be slightly reclined. Also, the buttock-foot member 12 may be generally horizontal. The back rest member 14 and the buttock-foot member 12 may collectively provide a sitting area upon which a person may rest his/her buttocks on the buttock-foot member 12 and lean backwards to rest his/her back upon the back rest member 14. To provide a more comfortable seating arrangement, one or more seat cushions 42 (see FIG. 1) may be placed on top of the buttock-foot member 12. The seat cushion 42 may be fabricated from any material used as a cushion or fabricated in any cushion configuration currently used or those that are developed in the future. Additionally, one or more back rest cushions 44 (see FIG. 1) may be laid against the back rest member 14 to provide a comfortable interface between the back rest member 14 and the user's back. Similar to the seat cushion 42, the back rest cushions 44 may be fabricated from any material and fabricated in any configuration that is currently used for back cushions known in the art or developed in the future.

To convert the sofa-bed 10 from a sofa to a bed, the user may unlock the sofa-bed 10 such that the user may pull the buttock-foot member 12 in a forward direction as indicated by arrow 90 in FIGS. 2 and 4. The buttock-foot member 12 may be supported by a plurality of wheels 46. The wheels 46 may be fixed (i.e., not swivelable) and oriented in the forward direction to aid in the easy conversion of the sofa-bed 10 from a sofa to a bed and vice versa. The wheels 46 may also be light weight. The buttock-foot member 12 may have four wheels 46. One wheel 46 may be located closely adjacent to each corner of the buttock-foot member 12. The left and right wheels 46 may be spread apart to provide stability to the buttock-foot member 12. Likewise, the front and rear wheels 46 may be spread apart to provide stability to the buttock-foot member 12. The wheels 46 permit the user to easily roll out the buttock-foot member 12 from the retracted position (see FIG. 2) to an extended position (see FIG. 3). Even if the buttock-foot member 12 is heavy, the wheels 46 support the weight such that the user may easily roll the buttock-foot member 12 between the retracted and extended positions.

The head rest member 16 and the back rest member 14 may collectively define a foldable section 48 (see FIGS. 3 and 4). When the sofa/bed 10 is in the folded position, the foldable section 48, and more particularly, the back rest member 14 and the head rest member 16 are in a generally vertical position as shown in FIG. 4. The head rest member 16 may be oriented generally vertical behind and covered by the back rest member 14. The back rest member 14 may be slightly reclined to provide a comfortable surface upon which the user may lean backwards and rest upon.

As discussed above, from the folded position, the buttock-foot member 12 may be traversed forward. As the buttock-foot member 12 is traversed forward, the foldable section 48 is brought to a generally horizontal position, as shown in FIG. 3. More particularly, the head rest member 16 may define a distal end portion 50 (see FIG. 4) and a proximal end portion 52 (see FIG. 4). The distal end portion 50 (see FIG. 4) of the head rest member 16 may be pivotably connected to the left and right arm rests 32*a, b*, as shown in FIG. 3. By way of example and not limitation, the distal end portion 50 of the head rest member 16 may be pivotably connected to the left and right arm rests 32*a, b* via rotating brackets 56*a, b* (see FIG. 3). The proximal end portion 52 of the head rest member 16 may be pivotably connected to a distal end portion 58 of the back rest member 14 such as via hinges 60*a, b* (see FIGS. 3 and 4). Similarly, a proximal end portion 62 of the back rest member 14 may be pivotably connected to a distal end portion 64 of the buttock-foot member 12 such as with hinges 60*c, d* (see FIGS. 3 and 4).

As the buttock-foot member 12 is pulled forward to the extended position, the foldable section 48 traverses to a generally horizontal position. The head rest member 16 pivots about the rotating brackets 56*a, b*. Simultaneously, the back rest member 14 rotates about the hinges 60*a, b* and the hinges 60*c, d*. The back rest member 14 and the head rest member 16 continues to rotate until they 14, 16 are in the generally horizontal position. At the generally horizontal position, the proximal end portion 52 of the head rest member 16 and/or the distal end portion 58 of the back rest member 14 may rest upon support members 66*a, b* (see FIGS. 3 and 4). The support members 66*a, b* may be positioned and sized and configured from the rear base board 30 a distance 68 (see FIG. 4) such that the proximal end portion 52 of the head rest member 16 and/or the distal end portion 58 of the back rest member 14 rests upon the support members 66*a, b* when the foldable section 48 is in the generally horizontal position, as shown in FIG. 3. Preferably, at the generally horizontal position, the upper sides 22, 24 and 26 of the buttock-foot member, back rest member 14 and the head rest member 16 are substantially coplanar and level with the floor, as shown in FIG. 3. The optional bed cushion 18 (see FIG. 3A) may then be placed on top of the buttock-foot member 12, back rest member 14 and the head rest member 16.

Figure 5:
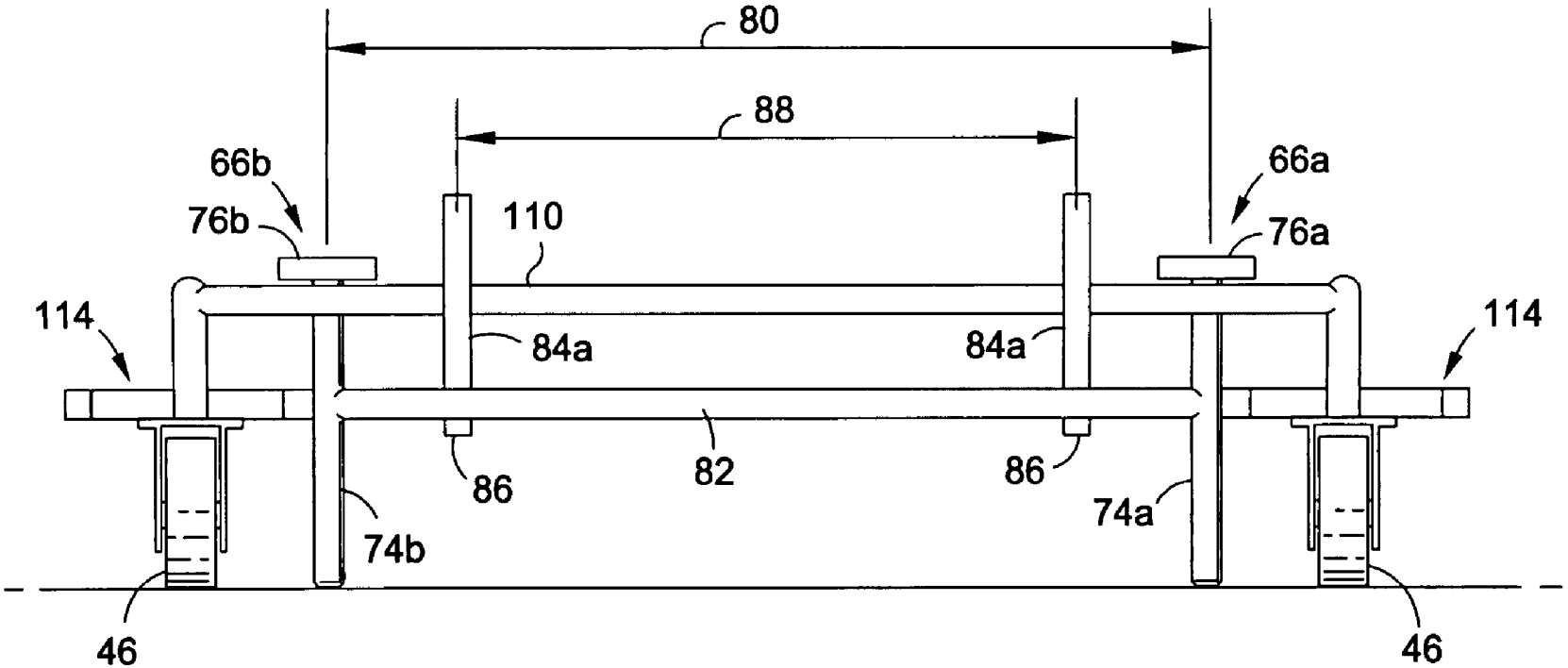
FIG. 5 is a partial front view of the frame of the convertible sofa-bed shown in FIG. 2.

The support member 66*a, b* may comprise two pedestals 74*a, b* (see FIGS. 3 and 4). The pedestals 74*a, b* may each have a flat upper bar 76*a, b* upon which the proximal end portion 52 of the head rest member 16 and/or the distal end portion 58 of the back rest member 14 rest upon, as shown in FIG. 3. To maintain the position of the pedestal 74*a, b*, longitudinal member 78*a, b* (see FIGS. 2, 3 and 4) may be attached to the rear base board 30 and extend forward to the pedestal 74*a, b*. The longitudinal member 78*a, b* may each be attached to the rear base board 30 with a bracket and screws. The proximal end of the longitudinal members 78*a, b* may be attached (e.g., welded) to the pedestals 74*a, b*. Likewise, the upper bars 76*a, b* may be welded to the pedestals 74*a, b*. The left and right wheels 46 disposed on the under side of the buttock-foot member 12 may be spaced apart so as to be wider than a width 80 (see FIGS. 2 and 5) of the support members 66*a, b*. The buttock-foot member 12 may be freely traversed between the retracted position and the extended position without interference between the wheels 46 and the support members 66*a, b*.

To assist the user in traversing the sofa-bed 10 back to the sofa configuration from the bed configuration, the foldable section 48 may be biased toward the generally vertical position when the sofa-bed 10 is in the bed configuration. By way of example and not limitation, two extensions 70*a, b* (see FIGS. 2, 3 and 4) may be attached to the head rest member 16. They 70*a, b* extend inward, as shown in FIGS. 2 and 3. Two more extensions 70*c, d* (see FIGS. 3 and 4) may be attached to the back rest member 14. They 70*c, d* may extend downward as shown in FIG. 3. A first spring 72*a* may be attached to the extensions 70*a, c*. A second spring 72*b* may be attached to the extensions 70*b, d*.

In the bed configuration (see FIG. 3), the springs 72*a, b* initially bias the foldable section 48 toward the generally vertical position. This aides the user in converting the sofa-bed 10 from a sofa to a bed. To convert the sofa-bed 10 from the bed to the sofa, the user may stand on a side of the sofa-bed 10. The weight of the buttock-foot member 12 and the back rest member 14 is greater than the spring force of the springs 72*a, b*. Accordingly, the foldable section 48 remains in the generally horizontal position at the bed configuration. The user then lifts the junction 19 of the back rest member 14 and head rest member 16 upward (see arrow 21 in FIG. 3) until the spring force overcomes the weight of the head rest member 16 and the back rest member 14. The springs 72*a, b* partially traverse the head rest member 16 and the back rest member 14 toward the generally vertical position. The head rest member 16 and the back rest member 14 may remain buckled even if the user stops lifting the junction 19 of the back rest member 14 and head rest member 16 upward. The user may then step towards the front of the buttock-foot member 12 and push the buttock-foot member 12 to the retracted position to complete the conversion of the sofa-bed 10 from the bed configuration to the sofa configuration.

To lock the sofa-bed 10 in the bed configuration or the buttock-foot member 12 in the retracted position, as shown in FIGS. 3 and 4, a transverse member 82 attached between pedestals 74*a, b* may catch a first locking member 84*a* when the buttock-foot member 12 is in the retracted position. More particularly, as shown in FIG. 4, in the retracted position, the first locking member 84*a* is disposed behind the transverse member 82. A lower distal end 86 (see FIGS. 4 and 5) of the first locking member 84*a* may be elevationally lower than the transverse member 82. In the event that the buttock-foot member 12 is urged forward, the first locking member 84*a* contacts the transverse member 82 to prevent the inadvertent traversal of the buttock-foot member 12 to the extended position.

To aid the user in disposing the locking member 84*a* behind the transverse member 82, a second member 84*b* (see FIG. 4) may be attached to the first locking member 84*a*. The second member 84*b* may be an elongate bar angled backward. When the first locking member 84*a* is in front of the transverse member 82, the second member 84*b* is also disposed in front of the transverse member 82. As the buttock-foot member 12 is being traversed to the retracted position, the second member 84*b* initially contacts the transverse bar 82. The user may lift and push the buttock-foot member 12 toward the retracted position such that the second member 84*b* slides against the transverse member 82. As the user continues to lift and push the buttock-foot member 12, the lower distal end 86 of the first locking member 84*a* traverses past the transverse member 82 and may drop behind the transverse member 82, as shown in FIG. 4.

Conversely, to traverse the buttock-foot member 12 to the extended position from the retracted position, the user may lift the locking member 84*a* up and over the transverse member 82. At which point, the buttock-foot member 12 may be traversed to the extended position. More particularly, the locking member 84*a* may be angled forward. This assists the user in sliding the first locking member 84*a* up and over the transverse member 82. From the retracted position, the user may pull and lift the buttock foot member 12 toward the extended position. The first locking member 84*a* may contact and slide against the transverse member 82. The user may continue to pull and lift the buttock-foot member 12 toward the extended position until the lower distal end 86 of the first locking member 84*a* traverses past the transverse member 82. The user may lower the buttock-foot member 12 such that the wheels 46 contacts the floor. The user may continue to pull the buttock-foot member 12 to the fully extended position.

The distance 88 (see FIGS. 2 and 5) between the first locking numbers 84*a* may be smaller than the width 80 of the support members 66*a, b*. When the buttock-foot member 12 is traversed to the retracted position, the wheels 46 roll past the outside of the support members 66*a, b* and the first and second members 84*a, b* are slid between the support members 66*a, b*.

Referring now to FIGS. 3, 4 and 4A, a support post 92 may be attached to a base of the rear wheels 46. The support post 92 may extend from the base of the wheels to an underside of the backrest member 14. More particularly, the distal end 94 (see FIGS. 4 and 4A) may contact a bottom surface 96 (see FIG. 4) of the proximal end portion 62 of the backrest member 14, when the sofa-bed 10 is in the bed configuration, as shown in FIGS. 3 and 4A. When the sofa-bed 10 is in the bed configuration, the rear wheels 46 support both the backrest member 14 and the buttock-foot member 12. The rear wheels 46 are preferably vertically aligned below the proximal end portion 62 of the backrest member 14 and the distal end portion 64 of the buttock-foot member 12. Accordingly, when a force is directed downward onto these two portions 62, 64, the forces are directed to the rear wheel 46 through both the support post 92 and the frame 98 of the buttock-foot member 12 to provide stability.

A handle 100 (see FIG. 3A) may be attached to a front portion of the buttock-foot member 12. The handle 100 may be utilized to pull the buttock-foot member 12 to the extended position from the retracted position. Moreover, the handle 100 may be utilized to lift the first and second members 84*a, b* up and over the transverse member 82 to lock or unlock the sofa-bed 10 in the sofa configuration. The handle 100 may be fabricated from a fabric material. Also, the handle 100 may be tucked under the seat cushions 42 when the sofa-bed 10 is in the bed configuration.

In an aspect of the sofa-bed 10, in an alternative embodiment of the bed-cushion 18, three separate cushions maybe attached to the upper sides 22, 24, 26 of the buttock-foot member, backrest member 14, and the headrest member 16, as shown in FIG. 3A. These separate cushions may extend to the lateral and longitudinal edges of the respective members 16, 14, 12. These cushions may each be fabricated from a soft plush material to provide a comfortable sleeping interface for the person. Moreover, these cushions may be permanently attached removeably upholstered (e.g., stapled, stitched, etc.) to the respective members 16, 14, 12. In the event that the cushions are removeably upholstered to the members 16, 14, 12, the end user may replace one or all three of the members 16, 14, 12 after the cushion(s) has been damaged or worn down. It is contemplated that the optional bed cushion 18 shown in FIG. 3A may be laid on top of these three separate cushions, or the three separate cushions may themselves constitute the bed cushion 18.

Referring now to FIGS. 3 and 4, the frame 98 (see FIG. 4) of the buttock-foot member 12 may comprise longitudinal and lateral members 102, 104. Extensions 106 (see FIG. 4) may be attached to the distal end portion 64 of the buttock-foot member 12. The extensions 106 may extend downward. These extensions 106 may also be attached to U brackets 108. The U brackets 108 may have an inverted U-orientation. Opposed distal ends of the U brackets 108 may be attached to the base of the front and rear wheels 46. The U brackets 108 fix the distance between the front and rear wheels 46. A transverse member 110 (FIG. 3) may be attached to the U brackets 108 to fix the distance between the left and right wheels 46. To stabilize the U brackets 108 and the wheels 46 to the longitudinal and lateral member 102, 104, extension 112 (see FIGS. 3 and 4) may be attached to the base of the front wheels 46 and a proximal end portion 38 (see FIG. 4) of the buttock-foot member 12. As can be seen from FIG. 4, the transverse member 110 is disposed in front of the pedestal 74*a, b* of the support members 66*a, b* when the buttock-foot member 12 is in the retracted position (see FIG. 4). Accordingly, the transverse member 110 does not interfere with the traversal of the buttock-foot member 12 between the retracted position and the extended position.

In an aspect of the sofa-frame 10, each of the buttock-foot member 12, backrest member 14 and the headrest member 16 may have a rectangular configuration. The corners of each of the members 12, 14, 16 may be rounded to prevent the corners from hurting an individual.

The buttock-foot member 12 may be locked into position when the buttock-foot member 12 is in the retracted position. As discussed above, the first locking member 84*a* contacts the transverse member 82 to prevent the buttock-foot member 12 from sliding forward to the extended position. To prevent the buttock-foot member 12 from sliding rearward toward the rear base board 30, stop members 114 (see FIGS. 2, 3 and 4) may be disposed behind the rear wheels 46. The stop member 114 may be attached to the left and right armrest 32*a, b* such as with screws. Also, the stop members 114 may be attached (e.g., screwed, welded, etc.) to the longitudinal members 78*a, b*. In the retracted position, the stop member 114 may contact the frame 98 of the buttock-foot member 12 including but not limited to the support post 92 to limit the rearward movement of the buttock-foot member 12. Accordingly, the buttock-foot member 12 is cradled between the stop members 114 and the transverse bar 82. More particularly, each of the stop members 114 may have a U-shaped configuration. The tines 116 of the stop members 114 may be attached to the longitudinal members 78*a, b* and the left and right armrest 32*a, b*. A base 118 of the stop members 114 may be attached to the tines 116 and be disposed behind the rear wheels 46. When the buttock-foot member 12 is urged rearward, the frame 98 of the buttock-foot member 12 or the support post 92 contacts the base 118 of the stop member 114 to prevent rearward motion of the buttock-foot member 12.

The sofa-bed 10 may also be lifted while in the sofa configuration. By way example not limitation, two people may lift the left and right armrest portions 32*a, b*. Gravity will tend to draw the headrest member 16, backrest member 14 and the buttock-foot member 12 downward. The buttock-foot member 12 is cradled between the transverse member 82 and the stop member 114. As the movers lift the sofa-bed 10, the first locking member 84*a* contact the transverse member 82, as shown in FIG. 4. Also, the support post 92 which are angled rearwardly contacts the base 118 of the stop members 114.

Figure 6:
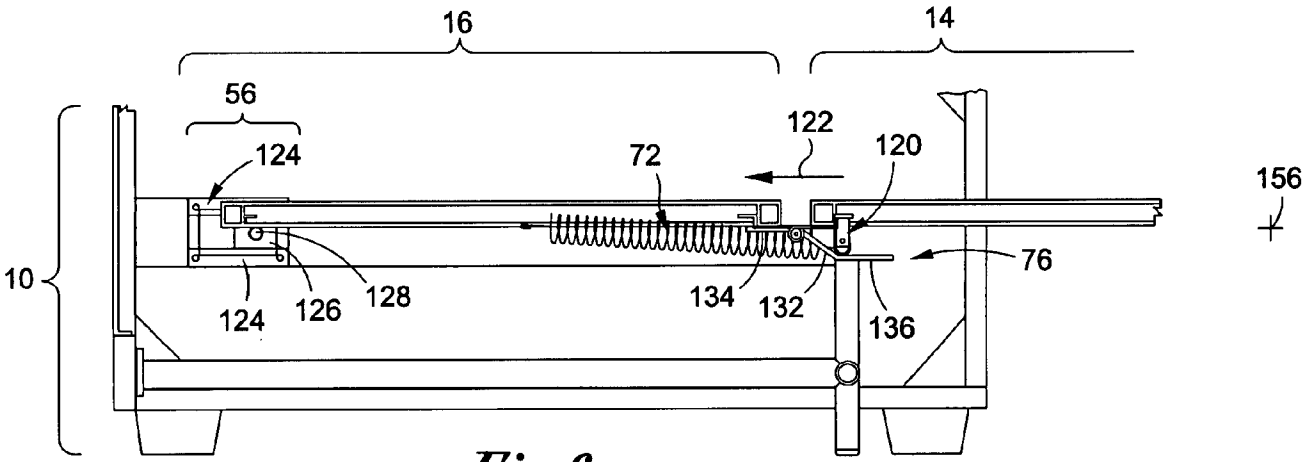
FIG. 6 is a side view of the frame of the convertible sofa-bed with a modified rotating bracket that permits the convertible sofa-bed to be traversed to the folded position from a front of the convertible sofa-bed.
Figure 7:
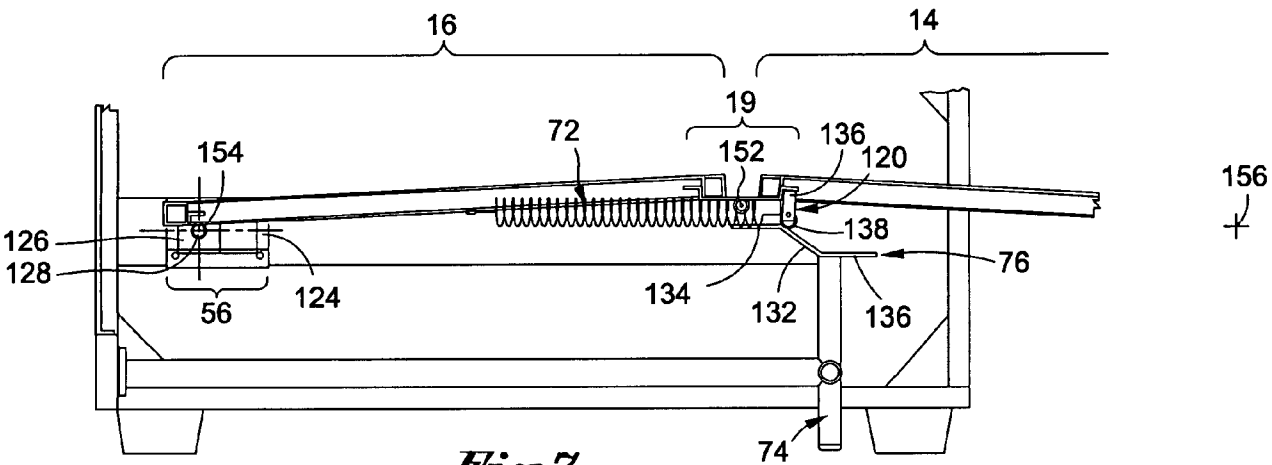
FIG. 7 is a side view of the frame of the convertible sofa-bed shown in FIG. 6 wherein a junction of a foldable section has been pushed upward.
Figure 8:
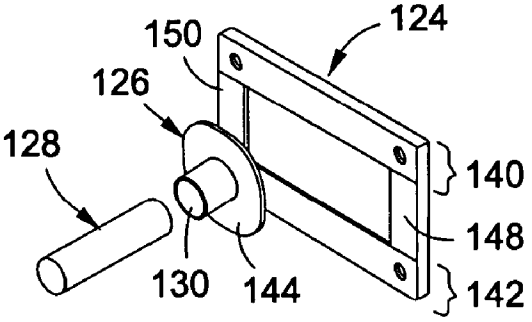
FIG. 8 is a perspective view of a sliding rotating bracket.
Figure 9:
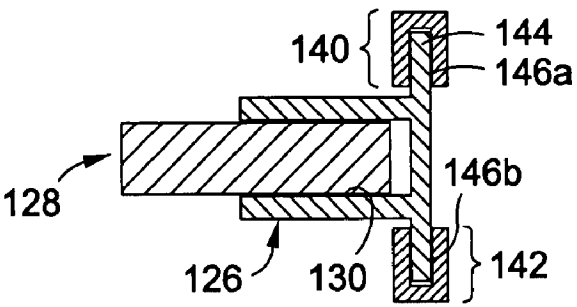
FIG. 9 is a cross-sectional view of a pin, a sliding member and a housing.

Referring now to FIGS. 6-9, generally, the rotating bracket 56, upper bar 76 have been modified. Also, a roller 120 has been added to the sofa-bed 10. These changes permit the sofa-bed 10 to be traversed to the folded position while the user remains in front of the buttock-foot member 12. The user does not have to move to the side of the sofa-bed to the lift the junction 19 (see FIG. 7) to start the process of traversing the sofa-bed 10 to the folded position. FIG. 6 illustrates the sofa-bed 10 while in the unfolded position. To traverse the sofa-bed 10 to the folded position, the user may push the buttock-foot member 12 (not shown in FIG. 6) in the direction of arrow 122 (see FIG. 6). Upon pushing the buttock-foot member 12 in the direction of arrow 122, the buttock-foot member 12, backrest member 14 and the headrest member 16 are slid toward the rear of the sofa-bed 10, as shown in FIG. 7. To this end, the rotating bracket 56 may comprise a housing 124, a sliding member 126 and a pin 128, as shown in FIG. 8. The pin may be fixedly attached (e.g., welded, etc.) to the headrest member 16. An opposed distal end portion of the pin 128 may be inserted into a receiving hole 130 of the sliding member 126, as shown in FIG. 9. The pin 128 may rotate within the receiving hole 130. The sliding member 126 may be traversed between a retracted position (see FIG. 7) and an extended position (see FIG. 6) within the housing. The housing 124 may be fixedly attached (e.g., screw, etc.) to the armrest 32. When the buttock-foot member 12 is pushed in the direction of arrow 122, the sliding member 126 moves backward to the retracted position (see FIG. 7).

As the sliding member 126 is traversed to the retracted position, the buttock-foot member 12, backrest member 14 and the headrest member 16 also move to the rear of the sofa-bed 10. The roller 120 attached adjacent the junction 19 is pushed upward by ramp portion 132 of the upper bar 76 to push the junction 19 upward. The upper bar 76 may have a Z shaped configuration and define the ramp portion 132 which is at an angle with respect to the general horizontal direction of arrow 122. A flat support surface 134 may be attached to a distal end of the ramp portion 132. The flat support surface 134 may be operative to support the junction 19 when the sofa-bed is in the unfolded position, as shown in FIG. 6. Moreover, in the unfolded position, the roller 120 may extend downward and optionally rest upon a flat support surface 136 of the upper bar. As can be seen by comparison of FIGS. 6 and 7, pushing the buttock-foot member 12 in the direction of arrow 122 raises the junction 19 (see FIG. 7). This simulates the lifting of junction 19 by hand as previously discussed in order to start the process of converting the sofa-bed 10 from the unfolded position to the folded position. In the sofa-bed 10 shown in FIGS. 6 and 7, the user need only push the buttock-foot member 12 in the direction of arrow 122 while remaining in front of the sofa-bed. The junction 19 is raised upward as the roller 120 rolls up on the ramp 132. The spring 72 may be sufficiently strong such that the weight of the backrest member 14 and the headrest member 16 is supported by the spring 72 when the roller 120 reaches the upper portion of the ramp portion 132 (see FIG. 7). Alternatively, the user may continue to push the buttock-foot member 12 in the direction of arrow 122 thereby further buckling the backrest member 14 and the headrest member 16 to the generally upright position until the spring 72 supports the weight of the backrest member 14 and headrest member 16. The spring 72 assists the user in traversing the sofa-bed 10 from the unfolded position to the folded position, as discussed above. The user may complete folding the sofa-bed by pushing the buttock-foot member 12 until the locking member 84 is behind or caught by the transverse bar 82.

The roller 120 may be comprised of an extension 136 (see FIG. 7) and a wheel 138 (see FIG. 7). The extension 136 may be attached to the backrest member 14 and positioned such that the wheel 138 contacts the ramp portion 132 when the sliding member 126 is in the retracted position (see FIG. 7). In this manner, the weight of the backrest member 14 and headrest member 16 may push the roller 120 down the ramp portion 132 and traverse the sliding member 126 to the extended position (see FIG. 6). When the sliding member 126 is at the extended position and the sofa-bed 10 is in the unfolded position, the roller 138 may optionally contact and be supported by the flat support surface 136.

As discussed above, the sliding member 126 may be traversed between a retracted position (see FIG. 7) and an extended position (see FIG. 6). To this end, the housing 124 may have an upper channel member 140 and a lower channel member 142, as shown in FIGS. 8 and 9. The sliding member 126 may have a flange 144. The upper and lower channel members 140, 142 may have opposed grooves 146*a, b*. The opposed grooves 140*a, b* may be sized and configured along with the flange 144 such that the flange 144 may be received into the opposed grooves 146*a, b*. The opposed grooves 146*a, b* may extend a substantial length along the longitudinal length of the upper and lower channel members 140, 142. In this manner, the sliding member 126 may slide between the retracted position and the extended position within the opposed grooves 146*a,b*.

To limit the forward and rearward travel of the sliding member 126 within the housing 124, front and rear backstops 148, 150 (see FIG. 8) may be attached to the opposed distal end portions of the upper and lower channel members 140, 142. Accordingly, as the sliding member 126 is traversed toward the extended position, the flange 144 contacts the front backstop 148 to limit forward movement of the sliding member 126. Conversely, as the sliding member 126 is traversed toward the retracted position, the flange 144 contacts the rear backstop 150 to limit rearward travel of the sliding member 126. The sliding member 126 may slide forward and rearward to permit the roller 120 to be pushed upward on the ramp 132 to buckle the headrest member 16 and the backrest member 14 and begin the process of folding the sofa-bed 10. Also, the sliding member 126 may slide within the housing 124 a sufficient distance to allow the roller to slide downward on the ramp 132 and allow the headrest member 16 and the backrest member 14 to reach a generally horizontal orientation.

To assist in the sliding of the sliding member 126 within the housing 124, a lubricant (e.g., grease) may be applied in the opposed grooves 146*a, b*. Moreover, lubricant (e.g., grease) may be applied within the receiving hole 130 to promote rotation of the pin 128 within the receiving hole 130.

In an aspect of the sofa-bed 10, other means of buckling the headrest member 16 and the backrest member 14 are also contemplated. Generally, the pivot axis 152 (defined by the rotation of headrest member 16 and the back rest member 14) should be misaligned or offset from the pivot axis 154 (defined by the pin 128) and pivot axis 156 (defined by the backrest member 14 and the buttock-foot member 12) to start the process of folding the sofa-bed 10 from the unfolded position to the folded position. By way of example and not limitation, it is contemplated that the pivot axis 154 may be lowered while maintaining the elevation of the pivot axis 152 when the buttock-foot portion 12 is pushed toward the rearward direction. This may also act to buckle the headrest member 16 and the backrest member 14 to start the process of traversing the sofa-bed 10 to the folded position from the unfolded position.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A convertible sofa comprising:

a base frame including a plurality of elongate support members having top and bottom ends, said top end including a top contacting surface; and an articulating mechanism comprising;

a headrest member traversable between a generally vertical position and a generally horizontal position, wherein in the generally horizontal position the headrest member contacts the contacting surfaces of said support members and is at least partially supported by the plurality of support members;

a backrest member pivotably connected to the headrest member, the backrest member traversable between a generally vertical position and a generally horizontal position wherein in the generally horizontal position the backrest member contacts the contacting surfaces of the support members and is at least partially supported by the plurality of support members; and a foot member pivotably connected to the backrest member, the foot member traversable between a retracted position when the headrest member and the backrest member are traversed to the generally vertical position and an extended position when the headrest member and backrest member are traversed to the generally horizontal position.

2. The convertible sofa of claim 1 further comprising a handle attached to the foot member.

3. The convertible sofa of claim 1 further comprising wheels attached to a bottom side of the foot member.

4. The convertible sofa of claim 1 wherein the foot member further comprises a catch to releasably engage said base frame when the foot member is in the retracted position to hold said articulating mechanism in a retracted seating position, and to disengage said base frame latch member when the foot member is in the extended position to allow the articulating mechanism to be in an extended bed position.

5. The convertible sofa of claim 1 wherein the headrest member, backrest member and the foot member are generally co-planar when the headrest member and backrest member are in the generally horizontal position.

6. The Convertible sofa of claim 1 further comprising at least one biasing member interconnected between said headrest member and said backrest member.

7. A convertible sofa comprising;

a sofa body comprising a back panel;

a base frame interconnected to said back panel, said base frame comprising;

a plurality of generally horizontal elongate side members positioned in spaced relation; and at least one elongate cross member interconnected to said side members;

a plurality of elongate leg members having top and bottom ends and interconnected to said base frame, said bottom ends providing floor support and said top ends providing a support contacting surface; and a foldable section traversable between a generally folded vertical position and a generally unfolded horizontal position, the foldable section comprising:

a headrest member, wherein in the unfolded generally horizontal position the headrest member contacts the contacting surfaces of said support members and is at least partially supported by the plurality of support members;

a backrest member pivotally connected to the headrest member wherein in the unfolded generally horizontal position the backrest member contacts the contacting surfaces of the support members and is at least partially supported by the plurality of support members; and a foot member pivotally connected to the foldable section, the buttock-foot member traversable in a generally horizontal plane between a retracted position and an extended position, the foot member traversable to the extended position when the foldable section is traversed to the generally horizontal position, the foot member traversable to the retracted position when the foldable section is traversed to the generally vertical position.

8. The convertible sofa of claim 7 wherein the foldable section is spring biased to the generally vertical position.

9. The convertible sofa of claim 8 wherein a spring force of a spring biasing the foldable section to the generally vertical position is less than weight of the headrest member and the backrest member when the foldable section is in the generally horizontal position.

10. The Convertible sofa of claim 7 further comprising at least one biasing member interconnected between said headrest member and said backrest member.

11. The convertible sofa of claim 7 wherein the foot member further comprises a catch to releasably engage said cross member of said base frame when the fool member is in the retracted position to hold said foldable section in a retracted seating position, and to disengage said cross member when the foot member is in the extended position to allow the foldable section to be in an extended bed position.

12. A convertible sofa comprising:

a base frame, said base frame comprising;

a plurality of generally horizontal elongate side members; and at least one elongate cross member interconnected to said side members;

a plurality of elongate leg members having top and bottom ends and interconnected to said base frame, said bottom ends providing floor support and said top ends providing a support contacting surface; and a foldable section having a headrest member and a backrest member, a proximal end portion of the headrest member being rotateably attached to a distal end portion of the backrest member, the foldable section traverseable between a generally vertical position and a generally horizontal position, the foldable section biased toward the generally vertical position when the foldable section is in the generally horizontal position, wherein in the unfolded generally horizontal position the headrest and backrest members contact the contacting surfaces of the plurality of support members and are at least partially supported by the plurality of elongate leg members; and a foot member having a distal end portion which is rotatably attached to a proximal end portion of the backrest member, the foot member being generally horizontally traversable between a retracted position and an extended position.

13. The convertible sofa of claim 12 further comprising:

a spring attached to the headrest member and the backrest member; and wheels attached to an underside of the foot member.

14. A convertible sofa comprising;

a sofa body comprising a back panel and side arms;

a base frame interconnected to said sofa body, said base frame comprising;

a plurality of elongate side members; and at least one elongate cross member interconnected to said side members;

a plurality of elongate leg members having top and bottom ends and interconnected to said base frame, said bottom ends providing floor support and said top ends providing a support contacting surface; and an articulating mechanism comprising;

a headrest member traversable between a generally vertical position and a generally horizontal position, wherein in the horizontal position the headrest member contacts the contacting surfaces of the plurality of elongate leg members and is at least partially supported by the plurality of elongate leg members;

a backrest member pivotally connected to the headrest member, the backrest member traversable between a generally vertical position and a generally horizontal position, wherein in the horizontal position the backrest member contacts the contacting surfaces of the plurality of elongate leg members and is at least partially supported by the plurality of elongate leg members; and a foot member pivotally connected to the backrest member, the foot member traversable between a retracted position when the beadrest member and the backrest member are traversed to the generally vertical position and an extended position when the headrest member and backrest member are traversed to the generally horizontal position.

15. The Convertible sofa of claim 14 further comprising at least one biasing member interconnected between said headrest member and said backrest member.

* * * * *